United States Patent [19]

Wetzel

[11] 4,228,779

[45] Oct. 21, 1980

[54] PROCESS AND A CIRCUIT ARRANGEMENT FOR THE CONTROL OF THE PRIMARY CURRENT IN COIL IGNITION SYSTEMS OF MOTOR VEHICLES

[75] Inventor: Klaus Wetzel, Munich, Fed. Rep. of Germany

[73] Assignee: Siemens Aktiengesellschaft, Berlin & Munich, Fed. Rep. of Germany

[21] Appl. No.: 949,791

[22] Filed: Oct. 10, 1978

[30] Foreign Application Priority Data

Oct. 25, 1977 [DE] Fed. Rep. of Germany ..... 2747819

[51] Int. Cl.[2] ..... F02P 1/08; H05B 41/14

[52] U.S. Cl. ..... 123/652; 123/146.5 A; 315/209 T; 123/644

[58] Field of Search ..... 123/148 E, 117 R, 146.5 A; 315/209 T

[56] References Cited

U.S. PATENT DOCUMENTS

| | | | |
|---|---|---|---|
| 3,575,154 | 4/1971 | Taylor | 123/148 E |
| 3,605,713 | 9/1971 | Masters et al. | 123/148 E |
| 3,831,571 | 8/1974 | Weber | 123/148 E |
| 3,882,840 | 5/1975 | Adamian et al. | 123/148 E |
| 3,937,193 | 2/1976 | Kim | 123/117 R |
| 3,943,896 | 3/1976 | Green et al. | 123/148 E |
| 4,153,032 | 5/1979 | Chateau | 123/148 E |

FOREIGN PATENT DOCUMENTS

| | | | |
|---|---|---|---|
| 2448915 | 4/1976 | Fed. Rep. of Germany . | |
| 2527726 | 1/1977 | Fed. Rep. of Germany | 123/148 E |
| 2530987 | 1/1977 | Fed. Rep. of Germany | 123/148 E |

*Primary Examiner*—P. S. Lall

*Attorney, Agent, or Firm*—Hill, Van Santen, Steadman, Chiara & Simpson

[57] ABSTRACT

The current through the primary winding of an ignition coil of an ignition system for a motor vehicle, and being largely independent of engine speed, supply voltage and internal resistance of the ignition coil, is controlled in a circuit in which a capacitor is charged only during the open time of a breaker contact and is discharged during the closed time of the contact, whereby the relationship of the charging current to the discharging current is equal to the relationship of open time to closed time of the contact. The current is switched on through the primary winding of the ignition coil as soon as the capacitor voltage falls below a threshold value and the current through the ignition coil is limited to an optimum value. The flow of current through the ignition coil is interrupted when the breaker contact is open and the aforementioned threshold voltage has not been reached at the same time.

10 Claims, 7 Drawing Figures

PROCESS AND A CIRCUIT ARRANGEMENT FOR THE CONTROL OF THE PRIMARY CURRENT IN COIL IGNITION SYSTEMS OF MOTOR VEHICLES

BACKGROUND OF THE INVENTION

1. Field of the Invention

The present invention relates to a process and to a circuit arrangement for the control of the current through the primary winding of an ignition coil for coil ignition systems in motor vehicles, which current has a character that is largely independent of engine speed, supply voltage and the internal resistance of the ignition coil.

2. Description of the Prior Art

The essential feature for the spark power of a motor vehicle ignition system is the magnitude of the primary current in the ignition coil, and the second feature is the peak current value which flows at the moment of initiation of arcing. In conventional ignition systems, the flow of current is directed through the primary coil directly through a breaker contact (points). During the closing time of the breaker contact, a current, rising according to an exponential function, flows through the primary winding of the ignition coil, whereby a magnetic field is built up which generates the high voltage in the secondary winding of the ignition coil during the open time of the contact, which voltage is necessary for the ignition of the gasoline-air mixture in the cylinder. The speed of the rise of the primary current through the ignition coil is determined by the relationship of inductance to the ohmic resistance of the coil. The closing angle of the contact is selected to be large enough that the primary current can rise, as much as is possible, up to the optimum final point, even in the case of the highest revolutions per minute. For this reason, one aims for the largest possible closing angle.

On the other hand, in the case of low revolutions per minute, it must be provided that the primary current does not rise to impermissibly high values during the long closing time of the breaker contact. For this reason, the smallest possible closing angle is desired. Since, however, for the reasons cited above, the closing angle cannot be selected as small as may be desired, a resistance that limits the current is usually connected in series with the primary winding of the ignition coil. In ignition systems common on the market, the closing angle of the breaker contact must be adjusted to a compromise value.

A further disadvantage of conventional ignition systems which are controlled directly through the points is that in case of motor idle, a constant current can flow through the primary winding of the ignition coil when the points happen to be closed. In such a situation, the battery is not only unnecessarily discharged, but the primary winding is also impermissibly loaded. For example, it can be seen from the German published application 24 48 915 a circuit arrangement which interrupts the flow of current through the primary winding when no ignition pulses are generated for a longer time. To this end, a capacitor is provided in this known circuit, whose potential is proportional to the number of ignition pulses occurring per unit of time. When ignition pulses are absent, the capacitor discharges and blocks the flow of current through the primary winding of the ignition coil by means of a transistor. The disadvantage in the case of this circuit, however, is that in the starting process a plurality of ignition pulses must first be generated by turning the starter until the capacitor is charged to the point that the transistor releases the flow of current through the primary winding.

SUMMARY OF THE INVENTION

The object of the present invention is to provide an improved circuit arrangement and process of the type generally mentioned above so that the conducting interval through the primary winding of the ignition coil is regulated to a nearly constant minimum value independent of the revolutions per minute of the motor and independent of the ignition order, and more specifically that in the case of idling, overload of the ignition coil cannot occur and that the primary current maintains its optimum value independent of revolutions per minute, operating voltage and internal resistance of the ignition coil.

The aforementioned object and attendant objects are achieved in that during the open time of the points, a capacitor is charged, and during the closing time of the points the capacitor is discharged, whereby the relationship of charging current to discharging current is equal to the relationship of open time to closing time. Furthermore, the current is switched on through the primary winding of the ignition coil as soon as the capacitor voltage exceeds a threshold value, the current through the ignition coil is limited to an optimum value, and the flow of current through the ignition coil is interrupted when the points are open and the aforementioned threshold voltage at the capacitor has not been achieved.

In a process in accordance with the present invention, the time interval during which the points are open is used for the determination of the momentary revolutions per minute. In this manner, even in the case of rapid alterations in the revolutions per minute as may occur in motor vehicles when accelerating, when braking or when changing gears, there is practically no longer any recognizable difference between the momentary revolutions per minute of the motor, according to which the time necessary for complete charging of the primary coil is measured, and the revolution per minute mathematically determined by the circuit. Known proposed solutions, which have as their object a control of the flow of current through the ignition coil for the purpose of ignition control (or timing) had to deduce the future revolutions per minute from the revolutions per minute of the motor calculated during the preceding revolutions, whereby considerable misinterpretations have sometimes occurred in the case of rapid alterations of the revolutions per minute. The computational process for the determination of the switching-on time for the primary current through the ignition coil is carried out with the help of the charging and discharging of the capacitor with constant currents. The greater the engine speed, the shorter the charging of the time-determining capacitor during the open time of the points and the lower its voltage; in the subsequent discharge, accordingly, the switching threshold, the attainment of which gives the command for the switching-on of the primary current to the ignition coil, is also achieved all the earlier, so that an approximate constant time interval is always available for the charging of the primary coil. By means of the additional limitation of the primary current to its optimum value, the rise of the primary current, which as is known proceeds according to an exponential function, can be limited to the steep portion at the beginning of this curve, so that the unnecessarily long current flow of the primary current can be avoided. The reduction of the current-time-integral thereby conditioned renders possible a limitation of the demand for energy of the ignition system.

According to a particular feature of the invention, the open time of the points is adjusted to approximately 20% of the total cycle of the points.

According to another feature of the invention, the circuit comprises a capacitor, a first engageable and disengageable constant current source for charging the capacitor during the open time of the points, a second engageable and disengageable constant current source for discharging the capacitor during the closed time of the points, a voltage comparator which emits the signal as soon as the capacitor voltage falls below a threshold value, an AND gate which emits a signal when the capacitor emits a signal and the points are closed at the same time, a power transistor which is activated by the signal of the AND gate, in whose collector circuit the ignition coil is connected and in whose emitter circuit a resistor is arranged, and a current limiting circuit which holds the signal constant that activates the power transistor, as soon as the voltage decreasing at the emitter resistor exceeds a threshold value.

According to another feature of the invention, a clamping circuit is provided which prevents a dropping of the capacitor voltage below a constant value.

According to another feature of the invention, a voltage stabilizer is provided which makes the operating voltage of the circuit independent of variations of the overall supply voltage.

According to another feature of the invention, ohmic voltage dividers are provided for the production of the constant threshold value voltages from the operating voltage.

According to another feature of the invention, ohmic voltage dividers are provided for adjusting the constant currents required for operation of the circuit.

According to another feature of the invention, a transistor is connected parallel to the control segment of the line of the power-switch transistor or of the appertaining driving transistor, whose base-emitter circuit is connected in parallel to the emitter resistor of the power transistor.

BRIEF DESCRIPTION OF THE DRAWINGS

Other objects, features and advantages of the invention, its organization, construction and mode of operation will be best understood from the following detailed description, taken in conjunction with the accompanying drawing, on which.

DESCRIPTION OF THE PREFERRED EMBODIMENTS

Figure 1:
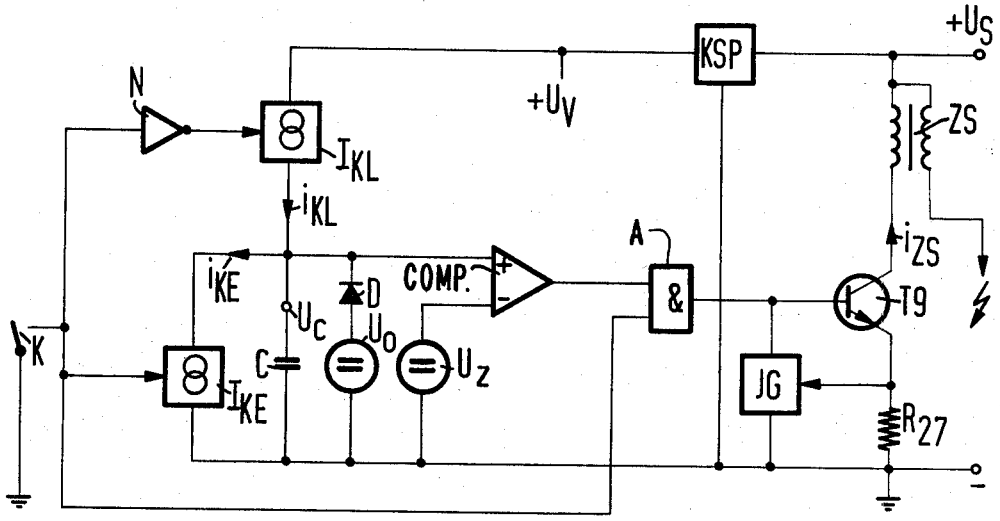
FIG. 1 is a schematic circuit diagram of an ignition system constructed in accordance with the present invention.

Referring to FIG. 1, a control circuit is illustrated in schematic block diagram form. On the left-hand side of the circuit, a breaker contact or points K are illustrated. It should, however, be pointed out that electronic points can also be advantageously employed in practicing the present invention. The information concerning whether the points K are open or closed is delivered to an initial switchable constant current source $I_{KL}$ by way of an inverter N. When the points K are open, a current $i_{KL}$ is fed to a capacitor C by way of the current source $I_{KL}$. Thereby, the voltage $U_C$ rises across the capacitor C. As soon as the points K close, the first current source $I_{KL}$ is turned off and a second controllable constant current source $I_{KE}$ is turned on. Thereby, the capacitor C is discharged with the constant current $i_{KE}$. In a voltage comparator COMP, the capacitor voltage $U_C$ is compared with a threshold voltage $U_Z$. As soon as the capacitor voltage $U_C$ falls short of the threshold voltage $U_Z$, the comparator COMP emits an output signal. The output signal is combined in an AND gate A with the signal coming from the points K, which signal symbolizes the switching state, in such a manner that only one signal appears at the output of the AND gate A when the capacitor voltage $U_C$ has fallen short of the threshold voltage $U_Z$ and the points K are simultaneously closed. A power switching transistor T9 is activated by the output signal of the AND gate A, and the transistor conducts a direct current $i_{ZS}$ through the primary winding of the ignition coil ZS. This current $i_{ZS}$ rises, as is known, according to an exponential law; its final value is dependent upon the magnitude of the supply voltage $U_S$ and the ohmic resistance in the primary circuit. In order to limit this current, at or to an optimum value, a resistor R27 is arranged in the emitter circuit of the power switching transistor T9. The voltage falling at the resistor R27, which voltage is proportional to the primary current $i_{ZS}$, is compared in a current limiting circuit IG with a threshold value preset in this circuit. As soon as the voltage at the resistor R27 exceeds the threshold value, the current limiting circuit IG conducts a portion of the control signal delivered from the AND gate A on the base of the power switching transistor T9 toward ground, so that the primary current $i_{ZS}$ is held at a constant value which corresponds to the optimum primary current of, for example, 10A at an operating network voltage of 12 V.

FIG. 1 further illustrates a constant voltage regulator KSP, which governs the supply voltage $U_S$, which in motor vehicles can vary within relatively wide limits, to a constant value, the constant value being suited as an operating voltage $U_V$ for the electronic circuits. The block diagram of FIG. 1 further contains a clamping circuit, which is illustrated by means of a constant voltage source $U_O$ and a clamping diode D. With the help of the clamping circuit, one obtains that the voltage $U_C$ at the capacitor C cannot fall below the value $U_O$. The capacitor C therefore is always charged beginning from the value $U_O$ and is discharged down to the value $U_O$. This measure contributes to a trouble-free functioning of the circuit arrangement.

Figure 2:
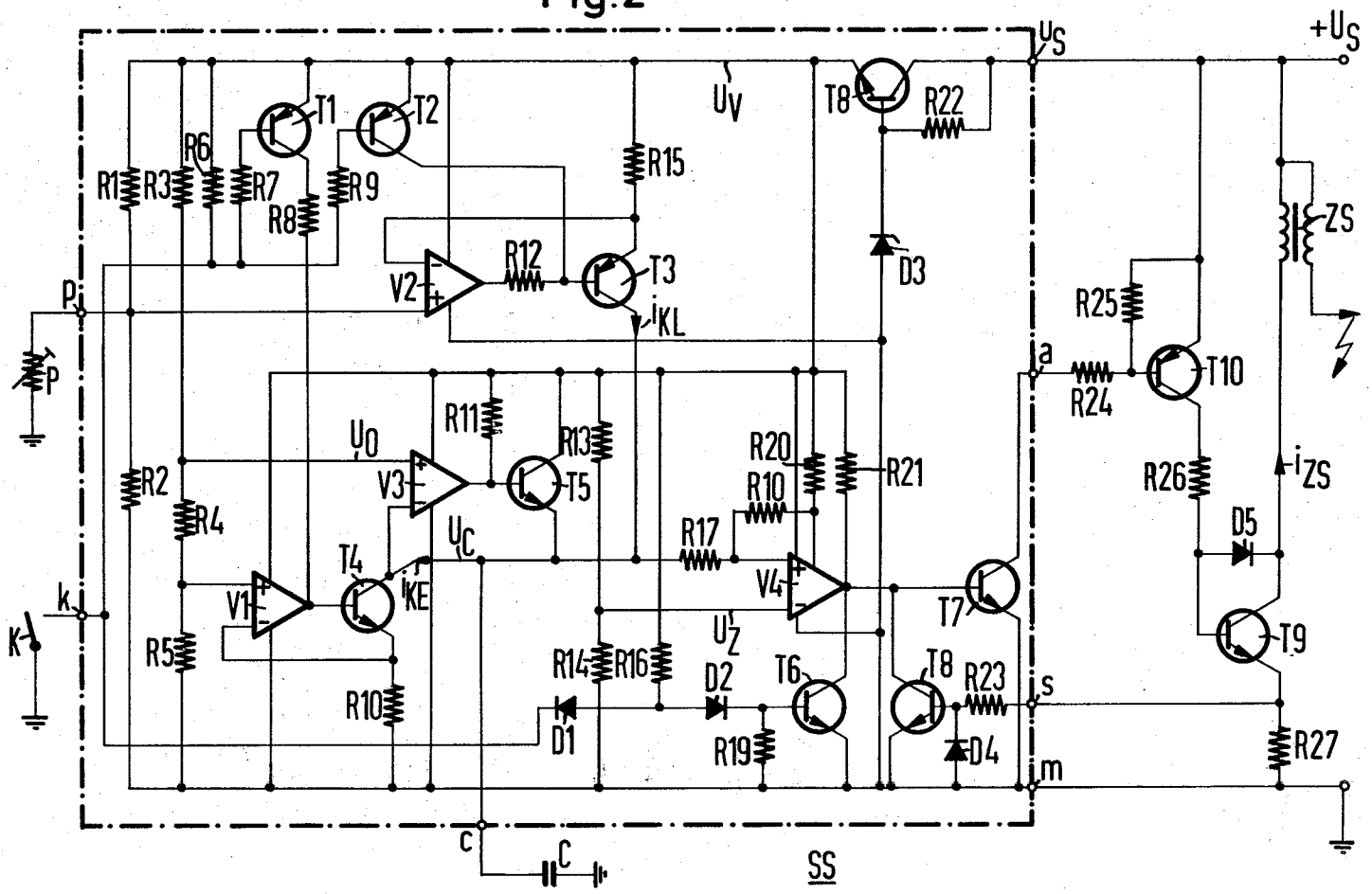
FIG. 2 is a schematic circuit diagram, showing the switching circuit of the present invention in greater detail.

FIG. 2 illustrates a practical realization of a circuit for practicing the invention. The portion of the circuit SS enclosed by the broken line can be advantageously developed as an integrated semiconductor circuit. One can again see the points K. The information concerning the switching state of the points K is delivered to the terminal k of the control circuit SS. This information is delivered by way of a pair of resistors R7, R9, respectively, to the bases of two transistors T1 and T2, respectively. When the points are closed, the transistors T1 and T2 are blocked. The switching state of the transistors T1 and T2, respectively, is delivered to the two constant current sources by way of respective resistors R8 and R12. The constant current source $I_{KL}$ for charging the time-determining capacitor C is formed by an operational amplifier V2 and a transistor T3 coupled thereto at the output side, as well as by a resistor R15 and a voltage divider comprising a resistor R1, a resistor R2 and a potentiometer P. The constant current source $I_{KE}$ for discharging the capacitor C is formed by an operational amplifier V1 and a transistor T4 connected to the output thereof, a resistor R10, and a voltage divider comprising a plurality of resistors R3, R4 and R5. Since the relationship of the charging current $i_{KL}$ to the discharging current $i_{KE}$ must be equal to the relationship of open time to closed time of the points K, an accurate balance can be obtained by way of the potentiometer P.

The clamping circuit discussed above with respect to FIG. 1 is formed by an operational amplifier V3 and a transistor T5 connected to the output thereof, a resistor R11 and the aforementioned voltage divider comprising the resistors R3, R4 and R5. The voltage tapped at the junction of the resistors R3 and R4 corresponds to the constant clamp voltage $U_O$.

The capacitor voltage $U_C$ is delivered by way of a resistor R17 to the noninverting input of an operational amplifier V4, which is connected as a voltage comparator with further resistors R18 and R20. The inverting input of the operational amplifier V4 is connected to the midpoint of a voltage divider comprising the resistors R13 and R14, whereby the tapped voltage corresponds to the threshold voltage $U_Z$.

The supply voltage $U_S$, which is applied to the control circuit SS at a terminal $U_S$, is regulated down to the operating voltage $U_V$ in a constant voltage regulator which comprises a transistor T8, a resistor R22 and a Zener diode D3. With this structure, influences of a fluctuating supply voltage $U_S$ on the function of the electronic circuits are avoided. Moreover, all constant voltages in the control circuit SS can be realized by means of simple voltage dividers.

In order to recognize the open and closed states of the points K, a current is fed over the points K by way of a resistor R16 and a diode D1. When the points K are open, a voltage of approximately the magnitude of the operating voltage $U_V$ appears at the terminal k; when the points K are closed, ground potential is applied to the terminal k. The potential at the terminal k, or at the junction of the resistor R16 and the diode D1 is fed by way of a diode D2 to the base of the transistor T6. The collector of the transistor T6 is connected with the output of the operational amplifier V4 of the voltage comparator. From this junction, a resistor R21 is connected to the operating voltage $U_V$. The AND operation is undertaken at the resistor R21.

The signal formed by means of the AND gate arrives at the base of a driver transistor T7, is amplified and is fed by way of a resistor R24 to the base of a further driver transistor T10, is again amplified and is fed by way of a further resistor R26 to the base of the power switching transistor T9 which has the primary winding of the ignition coil ZS connected in its collector circuit. A resistor R27 is connected in series between the emitter of the transistor T9 and ground and the transistor T9 is developed as a Darlington circuit with an integrated guard diode D5. The voltage falling at the emitter resistor R27 is fed to the base of a transistor T8 by way of a terminal s of the control circuit SS and by way of a resistor R23. As soon as the voltage falling at the resistor R27 exceeds the base-emitter voltage of the transistor T8, the transistor T8 becomes conductive and feeds a portion of the signal formed by means of the AND operation to ground, whereby the primary current $i_{ZS}$ through the ignition coil is held constant. The diode D4 connected between the base and the emitter of the transistor T8 serves as a guard diode.

The function of the invention will now be explained on the basis of FIGS. 3–7.

Figure 3:
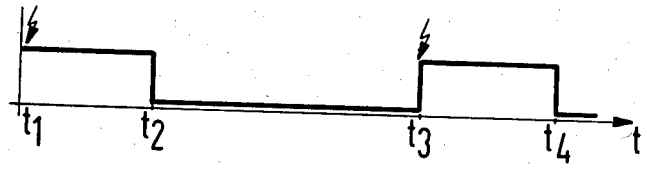
FIGS. 3–7 are voltage and current waveforms which illustrate the potentials and currents in the system at various times, as aids in understanding the present invention.

Referring to FIG. 3, the closing state of the points is illustrated with respect to time. At a time t1, the points open, whereby an ignition process occurs when a current had previously passed through the ignition coil. The points remain open until the time t2. From the time t2 until the time t3 the points are closed. At the time t3 the points again open, whereby an ignition process again occurs, and remain open until a time t4, at which time the points close again, and so on.

Figure 4:
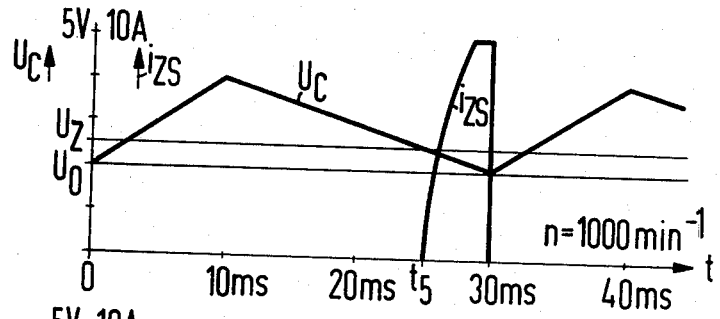

FIG. 4 illustrates the temporal course of the capacitor voltage $U_C$ and the primary current $i_{ZS}$ through the ignition coil at an rpm of $n=1000\ min^{-1}$. At $t=0$, the capacitor voltage $U_C$ rises linearly from the clamping voltage $U_O$, as long as the points are open. As soon as the points close after a time of 10 ms, the capacitor is discharged, whereby the capacitor voltage $U_C$ decreases linearly. As soon as the capacitor voltage $U_C$ falls below the threshold voltage $U_Z$—in this case at the time t5—, the primary current $i_{ZS}$ is turned on. The primary current rises according to an exponential function and is limited to its optimum value, in this example to 10 A. As soon as the points open, the primary current $i_{ZS}$ through the ignition coil is abruptly interrupted and an ignition process occurs. Simultaneously, the capacitor, whose voltage $U_C$ has in the meantime fallen down to the clamping value $U_O$, is again charged.

Figure 5:
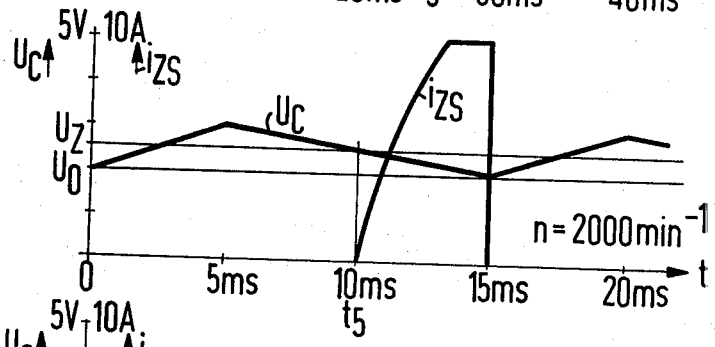

FIG. 5 shows the temporal course of the capacitor voltage $U_C$ and the primary current $i_{ZS}$ through the ignition coil at an rpm of $n=2000\ min^{-1}$. In viewing FIG. 5, one immediately appreciates that, in principle, the same course set forth above ensues at twice the engine speed. Since, however, only 5 ms remain available for the charging process, the capacitor is charged to a lower voltage. As a result of this action, the capacitor voltage $U_C$ more quickly attains the threshold voltage $U_Z$ during the discharging process, so that the same time interval is again available for the primary current $i_{ZS}$ through the ignition coil as was the case with respect to the situation illustrated in FIG. 4.

Figure 6:
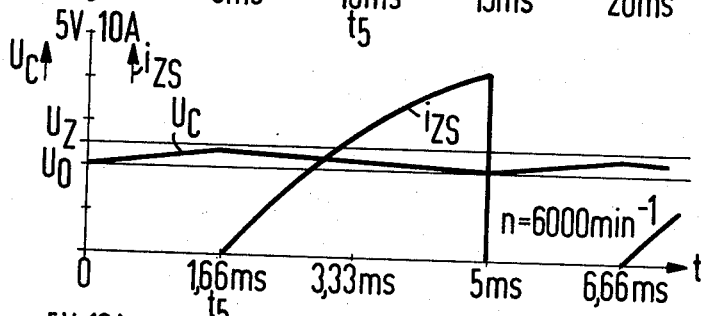

FIG. 6 illustrates the temporal course of the capacitor voltage $U_C$ and the primary current $i_{ZS}$ at an rpm of $n=6000\ min^{-1}$, which in the present example should correspond to a transgression of the range of control. The capacitor voltage $U_C$ rises linearly starting from the clamping voltage $U_O$. As a result of the high rpm's, the open time of the points is, however, too short to allow the capacitor voltage $U_C$ to exceed the threshold voltage $U_Z$. For this reason, in the moment in which the points K close, the connection condition for the switching-on of the primary current $i_{ZS}$ is fulfilled. The primary current rises according to an exponential function. Because of the excessive rpm's, however, the time interval available during the closed time of the points is not sufficient for the primary current to attain the optimum end value. The reduction of firing power, however, can be accepted, since the characteristic curve of ignition requirements of motors at high rpm's falls off anyhow.

Figure 7:
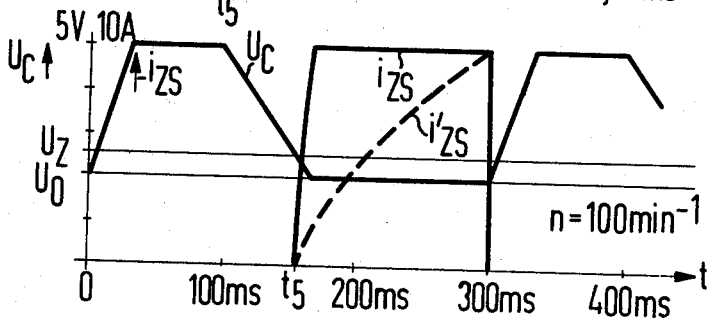

FIG. 7 illustrates the temporal course of the capacitor voltage $U_C$ and the primary current $i_{ZS}$ at an rpm of $n=100\ min^{-1}$, that is, for example, during the starting process of the engine. The capacitor voltage $U_C$ rises from the clamping voltage $U_O$ linearly. Since, as a result of the low rpm, however, the points are opened for a very long interval, and the capacitor voltage can none the less not rise above the value of the operating voltage $U_V$, the capacitor voltage is limited to this value. As soon as the points close, the discharge process begins. Since the capacitor, however, was not charged to its theoretical end value, but rather to a lesser value, the time t5 at which the capacitor voltage $U_C$ falls below the value of the threshold voltage $U_Z$ is also reached very early. Therefore, the primary current $I_{ZS}$, which is switched on at this time, reaches its limiting value very early and conducting intervals that are too long therefore result. Since this condition only arises during the starting of the motor, disadvantages possibly connected therewith could be effective for only a short time. It has turned out, however, that these disadvantages do not in reality occur, since, when starting, the supply voltage drops markedly for a short time, particularly in motor vehicles equipped with older batteries. The primary current through the ignition coil, therefore, rises significantly more slowly than in the case of a constant supply voltage and a course of operation ensues as has been illustrated by means of the broken curve $i'_{ZS}$. The drop of the battery voltage, therefore, is equalized by means of the longer duration of the coil charging process. For this reason, a separate regulation of the charging time in the case of low operating voltages can be dispensed with. If necessary, however, this regulation could be realized simply by means of a changing of a threshold voltage $U_Z$.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A circuit arrangement for controlling the current through the primary winding of an ignition coil of a motor vehicle in response to the open and closed time intervals of a cyclically operating points circuit and substantially independent of engine speed, supply voltage and the internal resistance of the ignition coil, comprising:

a capacitor;

a first constant current source connected to said capacitor and for connection to the points circuit and operable to charge said capacitor in response to the open time interval condition of the points circuit;

a second constant current source connected to said capacitor and for connection to the points circuit and operable to discharge said capacitor in response to the closed time interval condition of the points circuit;

a comparator connected to said capacitor and operable to produce a first signal in response to the voltage across said capacitor falling below a predetermined value;

an AND gate connected to said comparator and for connection to the points circuit and operable to produce a second signal in response to said first signal in conjunction with the closed time interval condition of the points circuit;

a resistor;

transistor means including an emitter circuit connected to a reference potential by way of said resistor, a collector circuit for connection to the supply voltage by way of the primary winding, and a base circuit connected to said AND gate, said transistor activated in response to said second signal to cause current to flow in series through said resistor and the primary winding; and a current limiting circuit connected to said resistor and said base circuit to hold said second signal constant in response to the voltage across said resistor reaching a predetermined value, said current limiting circuit comprising a transistor including a base-emitter circuit connected in parallel with said resistor, and a collector connected to said base circuit of said transistor means.

2. The circuit arrangement of claim 1, comprising:

voltage divider means connected to said first and second constant current sources for adjusting the charging and discharging currents of said capacitor.

3. The circuit arrangement of claim 2, wherein said base circuit of said transistor means includes at least one driver transistor.

4. The circuit arrangement of claim 1, comprising:

a clamping circuit connected to said capacitor and to said comparator for preventing the voltage across the capacitor falling below a second predetermined value.

5. The circuit arrangement of claim 4, comprising:

voltage divider means including a tap for providing a predetermined voltage value;

and wherein said clamping circuit comprises:

an operational amplifier including a non-inverting input connected to said tap, an inverting input connected to said capacitor, and an output; and a transistor including an emitter connected to said capacitor, a base connected to said output, and a collector connected to an operating voltage.

6. The circuit arrangement of claim 4, comprising:

a voltage regulator connecting the circuit arrangement to the supply voltage and providing an operating potential that is independent of variations of the supply voltage.

7. The circuit arrangement of claim 4, comprising:

voltage divider means connected between the operating voltage and the reference potential and including taps for providing the predetermined voltage values for said comparator and said clamping circuit.

8. The circuit arrangement of claim 7, wherein said comparator comprises:

an operational amplifier including a non-inverting input connected to said capacitor, an inverting input connected to a tap of said voltage divider means, and an output connected to said AND gate.

9. The circuit arrangement of claim 8, comprising:

a transistor including a collector connected to said output of said operational amplifier, an emitter connected to a reference potential and a base for connection to and to be controlled by the points circuit.

10. A circuit arrangement for controlling the current through the primary winding of an ignition coil of a motor vehicle in response to the open and closed time intervals of a cyclically operating points circuit and substantially independent of engine speed, supply voltage and the internal resistance of the ignition coil, comprising:

a capacitor;

a first constant current source connected to said capacitor and for connection to the points circuit and operable to charge said capacitor in response to the open time interval condition of the points circuit;

a second constant current source connected to said capacitor and for connection to the points circuit and operable to discharge said capacitor in response to the closed time interval condition of the points circuit;

a capacitor connected to said capacitor and operable to produce a first signal in response to the voltage across said capacitor falling below a predetermined value;

an AND gate connected to said comparator and for connection to the points circuit and operable to produce a second signal in response to said first signal in conjunction with the closed time interval condition of the points circuit;

transistor means including an emitter circuit connected to a reference potential by way of said resistor, a collector circuit for connection to the supply voltage by way of the primary winding, and a base circuit connected to said AND gate, said transistor activated in response to said second signal to cause current to flow in series through said resistor and the primary winding;

a current limiting circuit connected to said resistor and said base circuit to hold said second signal constant in response to the voltage across said resistor reaching a predetermined value;

voltage divider means including a plurality of taps for providing predetermined voltage values, and wherein each of said first and second constant current sources comprises an operational amplifier having an inverting input, a non-inverting input and an output, said non-inverting input connected to a respective tap, a first transistor having a base-emitter circuit connected between said output and said inverting input and a collector circuit connected to said capacitor, and a second transistor including an emitter circuit connected to an operating voltage, a collector circuit connected to said input, and a base circuit for connection to a points circuit for controlling activation and deactivation of the constant current source.

* * * * *